US011024987B2

(12) United States Patent
Koellmann et al.

(10) Patent No.: US 11,024,987 B2
(45) Date of Patent: Jun. 1, 2021

(54) CLAMPING SPRING AND CONDUCTOR CONNECTION TERMINAL

(71) Applicant: WAGO Verwaltungsgesellschaft mbH, Minden (DE)

(72) Inventors: Hans-Josef Koellmann, Minden (DE); Alexander Volkmann, Minden (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

(21) Appl. No.: 16/752,098

(22) Filed: Jan. 24, 2020

(65) Prior Publication Data

US 2020/0243986 A1 Jul. 30, 2020

(30) Foreign Application Priority Data

Jan. 25, 2019 (DE) ..... 10 2019 101 880.3

(51) Int. Cl.
*H01R 4/48* (2006.01)
*H01R 4/52* (2006.01)
*H01R 12/51* (2011.01)

(52) U.S. Cl.
CPC ..... *H01R 4/48* (2013.01); *H01R 4/52* (2013.01); *H01R 12/515* (2013.01)

(58) Field of Classification Search
CPC ..... H01R 4/48; H01R 4/52; H01R 12/515; H01R 4/4836
See application file for complete search history.

(56) References Cited

U.S. PATENT DOCUMENTS

| | | | | |
|---|---|---|---|---|
| 9,466,895 | B2 * | 10/2016 | Kollmann | H01R 4/4836 |
| 10,033,119 | B2 * | 7/2018 | Koellmann | H01R 13/508 |
| 2010/0081316 | A1 * | 4/2010 | Eppe | H01H 71/08 439/441 |
| 2011/0212653 | A1 * | 9/2011 | Koellmann | H01R 4/4827 439/700 |
| 2016/0006176 | A1 * | 1/2016 | Kollmann | H01R 13/62905 439/346 |

FOREIGN PATENT DOCUMENTS

| | | | |
|---|---|---|---|
| CN | 105375121 | A | 3/2016 |
| DE | 3515842 | * | 11/1975 |
| DE | 33 46 027 | A1 | 7/1985 |
| DE | 9002887 | U1 | 5/1990 |
| DE | 196 46 103 | C1 | 3/1998 |
| DE | 101 53 170 | C1 | 2/2003 |
| DE | 20 2016 104 374 | U1 | 12/2017 |
| DE | 202018104235 | U1 | 9/2018 |
| DE | 20 2017 105 162 | U1 | 1/2019 |
| JP | H06150169 | A | 5/1994 |
| WO | WO 2016/102322 | A1 | 6/2016 |

* cited by examiner

*Primary Examiner* — Jean F Duverne
(74) *Attorney, Agent, or Firm* — Muncy, Geissler, Olds & Lowe, P.C.

(57) ABSTRACT

A clamping spring of a conductor connection terminal for connecting an electrical conductor by means of spring-loaded clamping, wherein the clamping spring has a support leg to fix the clamping spring in the conductor connection terminal, a spring bend adjoining the support leg, and a clamping leg adjoining the spring bend, wherein the clamping leg is arranged to clamp the electrical conductor by means of its free end, wherein the clamping leg has at least one corrugation stamped into the material of the clamping leg. A conductor connection terminal with such a clamping spring is also provided.

21 Claims, 3 Drawing Sheets

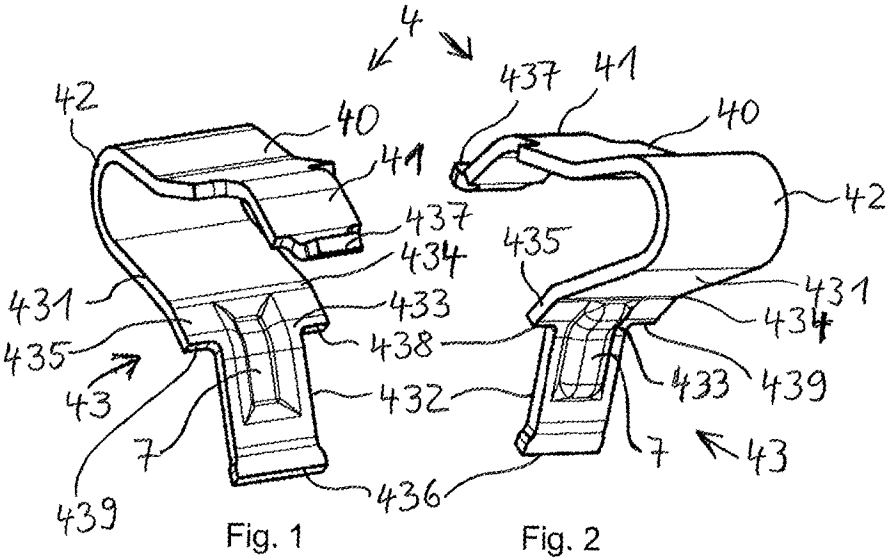
Fig. 1
Fig. 2
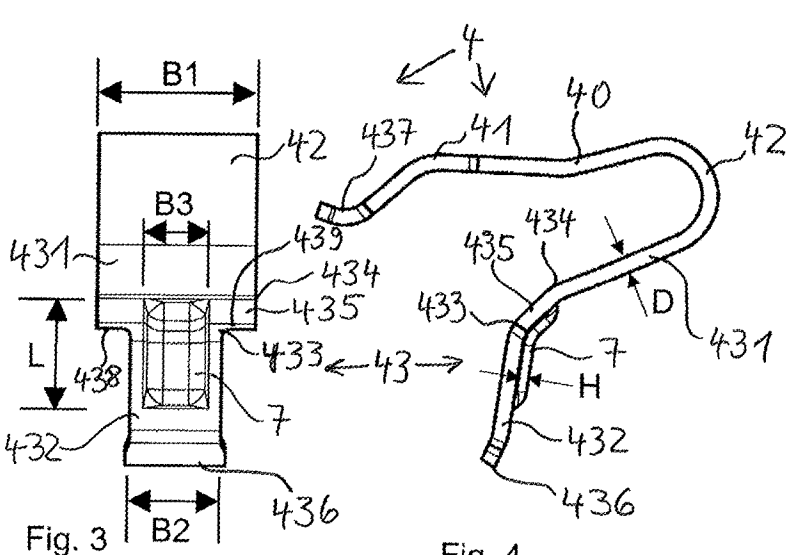
Fig. 3
Fig. 4
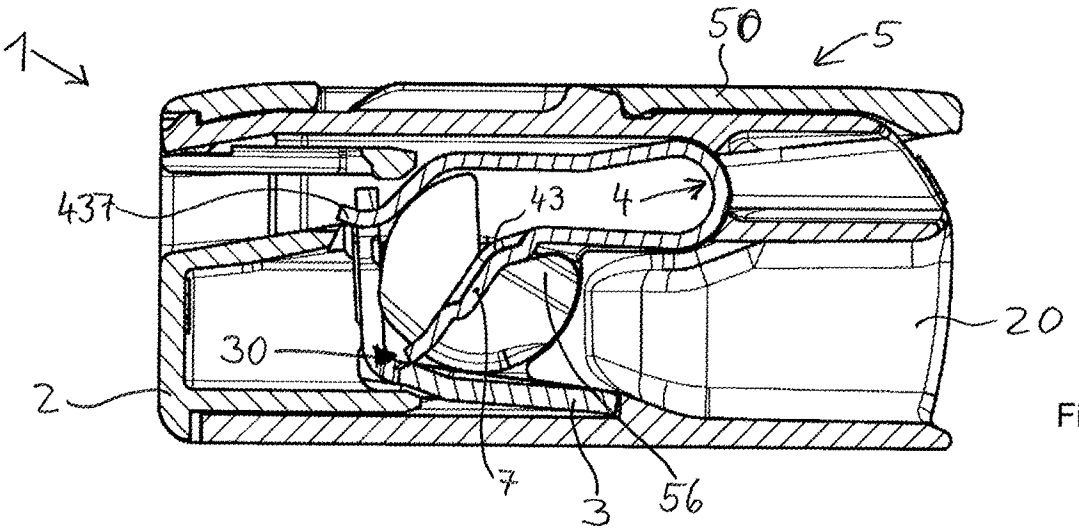
Fig. 5

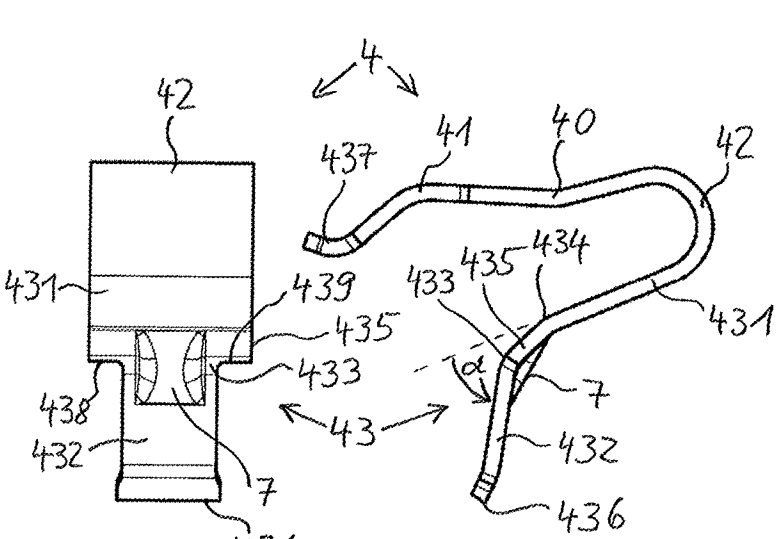
Fig. 9
Fig. 8
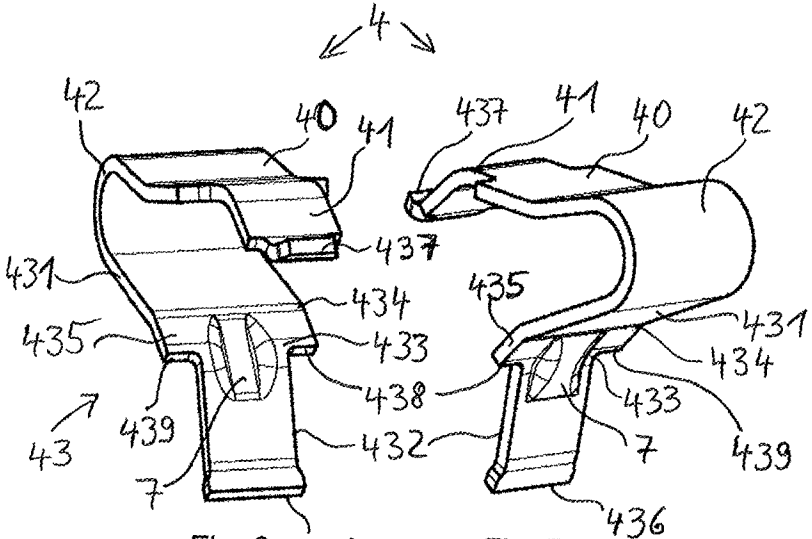
Fig. 7
Fig. 6
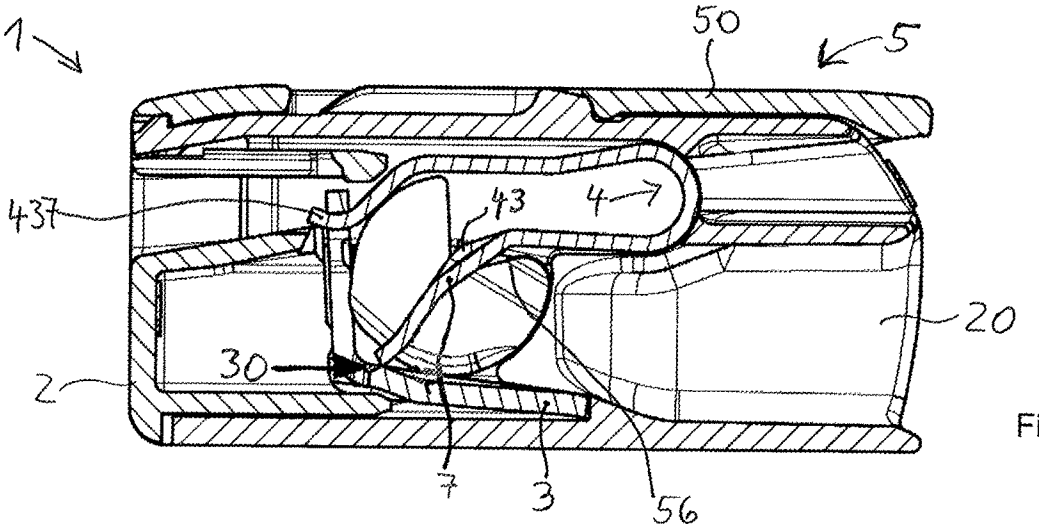
Fig. 10

CLAMPING SPRING AND CONDUCTOR CONNECTION TERMINAL

This nonprovisional application claims priority under 35 U.S.C. § 119(a) to German Patent Application No. 10 2019 101 880.3, which was filed in Germany on Jan. 25, 2019, and which is herein incorporated by reference.

BACKGROUND OF THE INVENTION

Field of the Invention

The present invention relates to a clamping spring of a conductor connection terminal for connecting an electrical conductor by means of spring-loaded clamping, wherein the clamping spring has a support leg to fix the clamping spring in the conductor connection terminal, a spring bend adjoining the support leg, and a clamping leg adjoining the spring bend, wherein the clamping leg is arranged to clamp the electrical conductor by means of its free end. The invention also relates to a conductor connection terminal with such a clamping spring.

Description of the Background Art

Conductor connection terminals and their clamping springs are known, for example, from WO 2016/102322 A1, which corresponds to U.S. Pat. No. 10,033,119, which is incorporated herein by reference.

Conductor connection terminals and their clamping springs differ from, for example, electrical plug and socket connectors by the significantly greater clamping force of the clamping spring, since in contrast to a plug and socket connector a conductor connection terminal is not designed for frequent mating and demating processes as is the case for a plug and socket connector.

SUMMARY OF THE INVENTION

It is therefore an object of the present invention to provide a solution that is beneficial in terms of manufacturing and cost for the area of conductor connection technology using spring-loaded clamping to increase the conductor retention force of such a conductor connection terminal and its clamping spring.

In an exemplary embodiment, a clamping spring is provided in that the clamping leg has at least one corrugation stamped into the material of the clamping leg. The corrugation can be implemented as a stamping, for example, or as any other type of recess in the clamping leg. As a result of the corrugation, the spring stiffness of the clamping leg is increased, in particular in a bend region of the clamping leg that may be present. In this way, the conductor retention force of the clamping spring, and of a conductor connection terminal designed therewith, can be increased in a simple and economical way without thereby increasing its size or increasing the weight and the material requirements for the clamping spring. The conductor retention force in this context is the force that acts against withdrawal of the electrical conductor from the clamping point.

The clamping leg can have a clamping edge at its free end for clamping the electrical conductor in place. As a result, the mechanical fixing and electrical contacting of the electrical conductor can be further improved and, in addition, the conductor retention force can be increased.

The clamping leg can have a first region adjoining the spring bend and a second region ending at the free end of the clamping leg, wherein the first region is connected to the second region through a bend region of the clamping leg where the clamping leg has a bent shape. This permits an especially compact construction of a conductor connection terminal equipped with the clamping spring.

The clamping spring can, for example, be designed such that the first region of the clamping leg adjoining the spring bend extends at least essentially parallel to the region of the support leg adjoining the spring bend, at least for a relaxed clamping spring or a deflected clamping spring. As a result of the bend region, the second region of the clamping leg can extend such that it is bent further away from the support leg, which is to say that the second region of the clamping leg forms a larger angle with the support leg than the first region.

The clamping leg, at least in the bend region, can have the at least one corrugation stamped into the material of the clamping leg. For a clamping spring in which the clamping leg has at least one bend region, it has been determined that it is possible to increase the spring stiffness in this critical region, which is to say the bend region, by a modification that is relatively simple to realize from a production standpoint, namely a stamped corrugation, and the section modulus can be increased in this way.

The corrugation can extend from the bend region into the first region and/or into the second region of the clamping leg. In this way, the reinforcing effect of the spring stiffness of the clamping leg is (further) optimized from a space and production standpoint. The corrugation can, for example, be arranged symmetrically with respect to the first and second regions, which is to say it can extend an equal distance from the bend region into the first and the second regions. It is advantageous here if the corrugation does not extend to the spring bend or to the free end of the clamping leg, but instead ends before each of these. Alternatively, the corrugation can also extend into the additional spring bend.

The clamping leg can have, between the first and second regions, an additional bend region in which the clamping leg has a bent shape. In this way, a clamping spring can be realized that is even better adapted to the relevant requirements of the conductor connection terminal with respect to shaping.

The bend region can be bent in the same bending orientation (same bending direction) as the additional bend region, or in the opposite bending orientation. The corrugation can extend, in particular, from the bend region to the additional bend region.

The bend region, together with the additional bend region, can also be viewed as a combined bend region, so that the corrugation stamped into the material of the clamping leg can be located in this combined bend region, which is to say that the corrugation can be arranged both in the bend region and in the additional bend region.

The corrugation can be configured such that it does not extend into the additional bend region. Accordingly, the corrugation is relatively short so that it ends before the additional bend region. Alternatively, the corrugation can also extend into the additional bend region.

The corrugation can have a bent contour that follows the bent course of the clamping leg in the bend region. As a result, the corrugation follows the contour path of the geometry of the clamping spring at least in the region of the clamping leg where the corrugation is arranged. The corrugation thus has a surface that extends at least approximately parallel to the bent shape of the clamping leg in the bend region.

The corrugation can span the bend region in a straight line. This allows especially simple production of the corrugation.

An angle between the first and the second regions of the clamping leg formed by the bend region is at least 10 degrees or at least 15 degrees. The angle can also take on larger values, for example at least 30 degrees or at least 40 degrees. The angle is thus formed between the second section of the clamping leg and an extension of the first region of the clamping leg.

Provision can also be made that, in the region of the corrugation, the material of the clamping leg can be deformed into an indentation on a stamped side of the clamping leg and into a projection on the side opposite the stamped side. Accordingly, the material of the clamping leg in the region of the corrugation is pushed in on the stamped side, and protrudes somewhat on the opposite side. The indentation thus forms a recess on the stamped side of the clamping leg, for example in the form of a concave-shaped indentation. The projection thus forms a protruding bump on the side of the clamping leg opposite the stamped side, for example in the form of a convex-shaped projection.

The convex-shaped side of the bend region can form the stamped side. The stamped side can, in particular, be the side of the clamping leg located opposite the support leg. In this way, the increase in the spring stiffness of the clamping leg can be optimized further.

The height of the projection can be less than the material thickness of the clamping leg in the bend region. Accordingly, the deformation of the material of the clamping leg by the corrugation is relatively slight so that undesirable material weakening of the clamping leg due to overly great degrees of deformation can be avoided.

With regard to its length dimension, the clamping leg extends from the spring bend to the free end. The clamping leg can be made of a spring-tempered sheet metal material whose material thickness simultaneously constitutes the thickness of the clamping leg (thickness dimension). The width of the clamping leg is the dimension that extends orthogonally to the thickness dimension and length dimension of the clamping leg. The height of the projection in this case is measured in the direction of the thickness dimension of the clamping leg, starting from the adjacent surface region of the clamping leg that is not deformed by the corrugation on the side opposite the stamped side.

The corrugation does not extend over the entire width of the clamping leg. In particular, the corrugation can be crimped within the width of the clamping leg so that it does not extend as far as the left-hand and right-hand side edges in the direction of the width dimension of the clamping leg. In this way, a sufficiently stiff cross-sectional profile of the clamping leg can be achieved by the corrugation without additional weakening. The length of the corrugation, measured in the longitudinal direction of the clamping leg, can be one to five times the width of the corrugation, for example.

The clamping leg can have at least one narrowing by which the width of the clamping leg is reduced from the spring bend in the direction of the free end of the clamping leg, wherein the corrugation is arranged in the region of the clamping leg that has the narrowing. In this way, a region of the clamping leg that is especially critical with regard to the spring stiffness can be reinforced by the corrugation.

The narrowing can be designed as a continuous narrowing, e.g., with a linear or nonlinear transition from a wide region of the clamping leg to a narrower region of the clamping leg. As explained, the narrower region of the clamping leg is located closer to the free end of the clamping leg than the wider region of the clamping leg. The narrowing can also be designed as a steplike reduction in width. This has the advantage, in particular, that an operating element for operating the clamping spring, for example an operating lever, an operating button, or another tool, can engage the at least one step formed laterally on the clamping leg in this way. The steplike shoulder thus formed can therefore be used as an operating tab of the clamping spring. The narrowing can be present on the clamping leg on one side or both sides. Accordingly, the steplike reduction in width can also be present on the clamping leg on one side or both sides. Through an arrangement of the steplike reduction in width on both sides, a bilateral, symmetrical application of force to the clamping leg for opening the clamping point can be exerted, in particular.

The corrugation can have its greatest length dimension in the direction of the longitudinal extent of the clamping leg. The corrugation's main direction of extent thus corresponds to the direction of the longitudinal extent of the clamping leg. An especially efficient increase in the clamping force of the clamping spring can be realized in this way.

The abovementioned object is also attained by a conductor connection terminal for connection of an electrical conductor by means of spring-loaded clamping, having at least a clamping spring, a busbar, and an insulating housing that at least substantially encloses the clamping spring and the busbar, wherein the clamping spring is designed as a clamping spring of the type discussed above. The above-discussed advantages can be realized by this means as well.

The conductor connection terminal can have a pivoting operating lever for manual operation of the clamping leg of the clamping spring. The operating lever serves to open and/or close a clamping point, formed between the clamping leg and the busbar, for clamping the electrical conductor. Thus, the clamping point formed between the clamping leg and the busbar can be opened or closed at the user's option by means of the operating lever. This allows simple and ergonomic operation of the conductor connection terminal. No additional tool is needed for operating the clamping leg.

The operating lever can have a left-hand and a right-hand side flange. A conductor receiving space to accommodate the electrical conductor that is clamped in place at the clamping point can be arranged between the left-hand and right-hand side flanges. This makes it possible to achieve an especially compact conductor connection terminal, since the space that is used in part by the operating lever can be used simultaneously for placement of the electrical conductor. The electrical conductor can thus be inserted or passed between the left-hand and right-hand side flanges of the operating lever in order to be connected in the conductor connection terminal.

The operating lever can have at least one operating element, for example an operating contour that acts mechanically on the clamping leg to operate the clamping leg. The operating element then acts on an operating tab of the clamping leg. Especially in the case of a clamping leg with a narrowing design, the operating tab of the clamping leg can be arranged in the wider region of the clamping leg.

For the purposes of the present invention, the indefinite article "a" is not to be understood as a number. Thus, for example, if reference is made to "a component," this is to be interpreted in the sense of "at least one component." If angles are specified in degrees, these specifications refer to a circular measurement of 360 degrees (360°).

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein:

FIGS. 1 to 4 show a clamping spring in various views;

FIG. 5 illustrates a conductor connection terminal with a clamping spring from FIGS. 1 to 4 in a sectional side view;

FIGS. 6 to 9 show a clamping spring in various views;

FIG. 10 shows a conductor connection terminal with a clamping spring from FIGS. 6 to 9 in a sectional side view;

DETAILED DESCRIPTION

Figure 11:
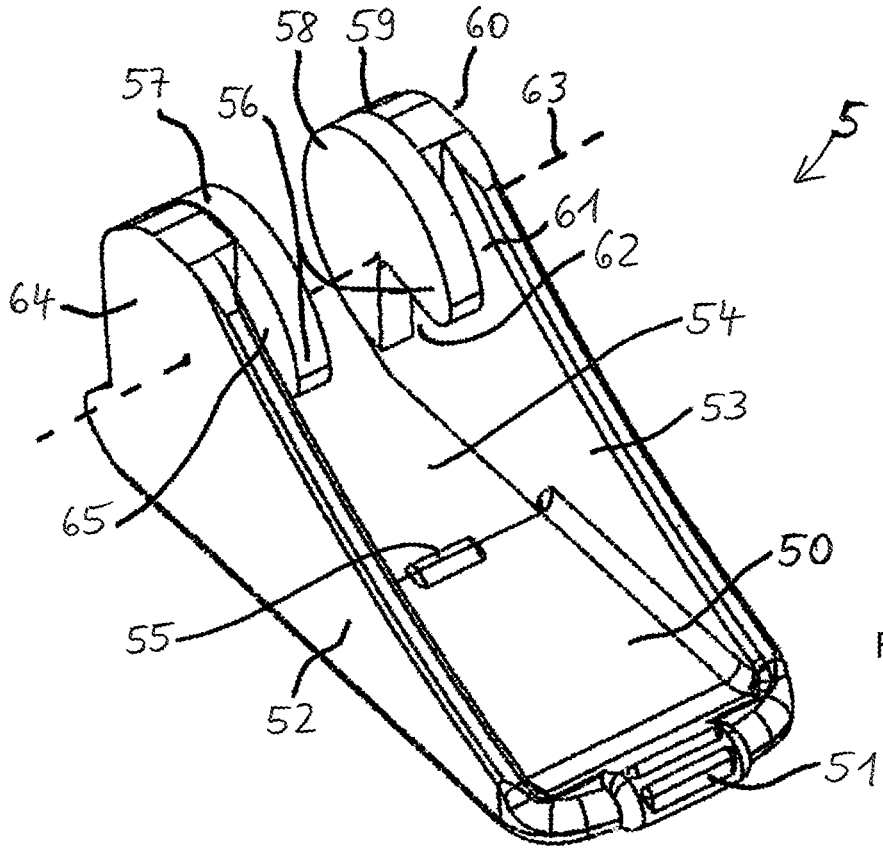
FIG. 11 shows an operating lever in a perspective view.

With reference to FIGS. 1 to 4, an exemplary embodiment of a clamping spring 4 is described. The clamping spring 4 has a support leg 40, a spring bend 42 adjoining the support leg 40, and a clamping leg 43 adjoining the spring bend 42.

The support leg 40 serves to fix the clamping spring 4 in the conductor connection terminal 1, for example to a busbar 3, an insulating housing 2, or another component of the conductor connection terminal 1 suitable for fastening the clamping spring 4. For this purpose, the support leg 40 has, at its free end, a bent attachment section 437. By means of the attachment section 437, the support leg 40 can be secured in a recess of a busbar 3, for example. As is evident, the support leg 40 can be designed such that it narrows from the spring bend 42 to its free end, for example narrows in a single step or multiple steps. In the exemplary embodiment it is shown that the support leg 40 becomes narrower in the transition to a section 41. The attachment section 437 can be made even narrower than the section 41.

The clamping leg 43 has a first region 431 that adjoins the spring bend 43. The clamping leg 43 additionally has a second region 432 that ends with the free end of the clamping leg 43. A clamping edge 436 can be present at the free end of the clamping leg 43, for example. The clamping leg 43 transitions from the first region 431 through one or more bend regions 433, 434 into the second region 432. Two bend regions 433, 434 are shown by way of example. The clamping leg 43 has an intermediate region 435 between the bend regions 433, 434.

The clamping leg 43 can likewise be designed to narrow toward the free end, as shown, which is to say that the width of the clamping leg 43 decreases from the spring bend 42 to the free end. The width of the clamping leg can decrease from the dimension B1 to B2, for example. For this purpose, the clamping leg 43 can have a narrowing 438, 439 by means of which the reduction in width takes place continuously, or, as shown in the exemplary embodiment, stepwise. It is shown by way of example that a narrowing 438, 439 is present on each of the two sides of the clamping leg 43, which is to say to the left and right of the narrower second region 432. The wider material regions of the clamping leg adjoining the narrowing 438, 439 can be used, for example, as operating tabs for operating the clamping leg 43 by an operating lever 5, an operating button, or an operating tool.

The clamping leg 43 has, at least in the bend region 433, a corrugation 7 stamped into the material of the clamping leg 43. The corrugation 7 serves to increase the spring stiffness of the clamping leg 43. As is evident, the corrugation 7 extends from the bend region 433 a distance into the second region 432. In the other direction, the corrugation 7 can extend from the bend region 433 a distance into the first region 431, or at least into the intermediate region 435. For example, the corrugation 7 can end before the additional bend region 434.

It is also advantageous if the width B3 of the corrugation 7 is smaller than the width of the clamping leg 43 in the region having the corrugation 7, which is to say smaller than the dimension B2. The length L of the corrugation 7 can advantageously be greater than the width B3 of the corrugation 7, for example one to five times the width B3. The height H of the corrugation 7 can advantageously be smaller than the material thickness D of the clamping leg 43, in particular the material thickness of the clamping leg 43 in the bend region 433.

FIG. 5 shows the installation of the above-described clamping spring 4 in a conductor connection terminal 1. The conductor connection terminal 1 has an insulating housing 2. The clamping spring 4 and a busbar 3 are arranged in the insulating housing 2. The busbar 3 can be angled in design, for example, so that the clamping spring 4 can be secured in a recess of the busbar 3 by its support leg 40 or the attachment element 437. The clamping leg 43 in this design is preloaded relative to the busbar 3 so that a clamping point 30 for connecting the electrical conductor is formed between the clamping edge 436 and the busbar 3. The electrical conductor can be inserted into the insulating housing 2 through a conductor insertion opening 20 and guided to the clamping point 30.

The conductor connection terminal 1 has an operating lever 5 that can be manually operated by a user in a pivoting motion at a manual operation region 50. By this means, an operating element 56 of the operating lever 5 can be moved that presses against the clamping leg 43 in the region of the relevant narrowing 438, 439 and thereby deflects the clamping leg 43 toward the support leg 40. As a result, the clamping edge 436 is moved away from the busbar 3 so that the clamping point 30 is opened.

The exemplary embodiments from FIGS. 1 to 5 show an embodiment of the clamping spring 4 in which the corrugation 7 is implemented as a corrugation that follows the contour of the clamping spring 4. Since the corrugation 7 extends beyond the bend region 433 on both sides, it accordingly is also bent in design in a side view.

FIGS. 6 to 9 show an embodiment of the clamping spring 4 that corresponds to the embodiment from FIGS. 1 to 5 except for the shape of the corrugation 7. In FIGS. 6 to 10, the corrugation 7 is not designed to follow the contour of the clamping spring, but instead extends in a straight line beyond the bend region 433. It is advantageous in this design when the corrugation 7 is arranged symmetrically with respect to the bend region 433, which is to say that the corrugation 7 extends approximately the same distance from the bend region 433 in both directions into the adjoining regions of the clamping leg 43.

FIG. 9 also shows the determination of the angle $\alpha$ between the first and the second sections 431, 432 of the clamping leg 43 formed by the bend region 433. The angle can be at least 10 degrees or at least 15 degrees, in particular.

FIG. 10 shows the installation of the above-described clamping spring 4 in a conductor connection terminal 1, which otherwise corresponds to the embodiment from FIG. 5.

FIG. 11 shows a perspective view of the operating lever 5 from below.

The design, which in principle is U-shaped in cross-section, can be seen here, with two spaced-apart side wall sections 52, 53 that are connected to one another at their free ends at a side edge by the manual operating region 50, which forms a transverse rib. It is clear that the side wall sections 52, 53 extend from the end regions 60, 64 on the pivot bearing side in a taper toward the free end. It can be seen that an operating boss 51 is present at the free end of the manual operating region 50. It is also clear that the manual operating region 50 extends forward past the free ends of the side wall sections 52, 53, wherein the inner side of the manual operating region 50 is inclined at the free end edge. This counteracts slipping when a lever operating force is applied to the manual operating region 50.

Present between the side wall sections 52, 53 is a conductor receiving space 54 to accommodate the electrical conductor to be connected.

It can further be seen that partially circular operating disks 57, 58 with a V-shaped notch 62 are arranged so as to be spaced apart from the side wall sections 52, 53 by a guide slot 61, 65. Formed in the region of each of the V-shaped notches 62 is an operating section 56 that serves to apply a spring operating force to the associated clamping leg 43. It can be seen that the operating sections 56, in like manner to the manual operating region 50 on which a lever pivoting force is exerted, are located on the same side relative to the pivot axis 63. This has the result that the spring operating forces exerted through the operating sections 56 act on the same side relative to the pivot axis 63 as the lever pivoting force applied for pivoting to the manual operating region 50.

It can further be seen that the operating disks 57, 58 have partially circular, curved outer end faces 59 with which the operating lever 5 is mounted in the housing part 1 so as to be pivotable about a virtual pivot axis 63.

The pivot axis 63 extends through the center of a partial circle formed by the outer end face 59.

It is clear, in addition, that a latch 55 projects toward the conductor receiving space 54 from the manual operating region 50 on the side opposite the operating boss 51. The latch 55 serves to latch the operating lever 5 with the insulating housing 2 in the closed position.

Figure 12:
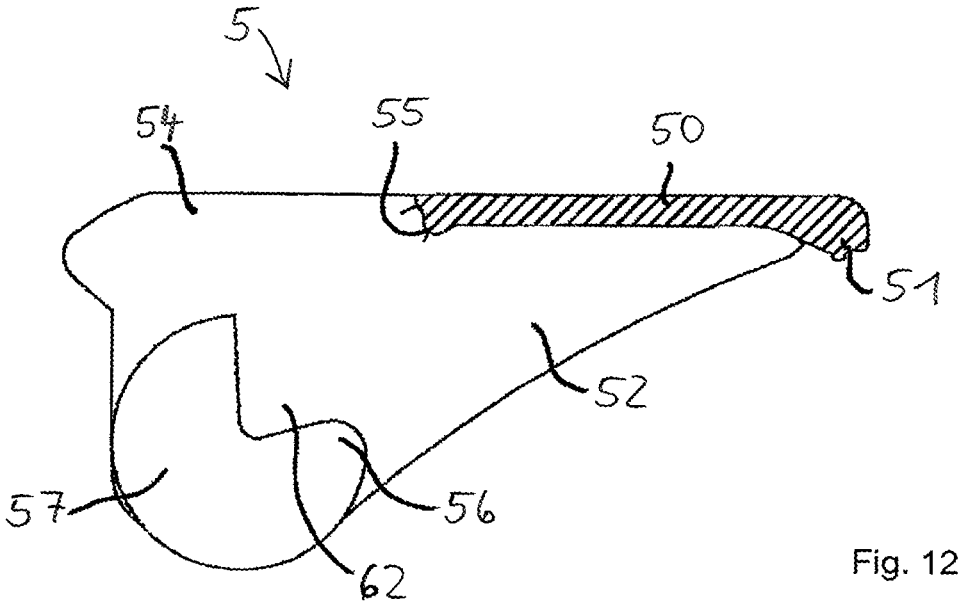
FIG. 12 shows the operating lever from FIG. 11 in a sectional representation from the side.

FIG. 12 shows a sectional side view through the operating lever 5 from FIG. 11. It is clear here again that the side wall sections 52, 53 are connected by the manual operating region 50 at the top of the operating lever 5. The manual operating region 50 in this case extends over only a subregion of the length of the side wall sections 52, 53 and in doing so preferably occupies more than half of the length of the side wall sections 52, 53.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A clamping spring of a conductor connection terminal for connecting an electrical conductor via a spring-loaded clamping, the clamping spring comprising:

a support leg to fix the clamping spring in the conductor connection terminal;

a spring bend adjoining the support leg; and a clamping leg adjoining the spring bend, wherein the clamping leg is arranged to clamp the electrical conductor via its free end, wherein the clamping leg has at least one corrugation stamped into a material of the clamping leg, wherein the clamping leg has a first region adjoining the spring bend and a second region ending at a free end of the clamping leg, and wherein the at least one corrugation ends before the free end.

2. The clamping spring according to claim 1, wherein the first region is connected to the second region through a bend region of the clamping leg where the clamping leg has a bent shape.

3. The clamping spring according to claim 2, wherein the clamping leg, at least in the bend region, has the at least one corrugation stamped into the material of the clamping leg.

4. The clamping spring according to claim 3, wherein the corrugation extends from the bend region into the first region and/or into the second region of the clamping leg.

5. The clamping spring according to claim 2, wherein the clamping leg has, between the first and second regions, an additional bend region in which the clamping leg has a bent shape.

6. The clamping spring according to claim 5, wherein corrugation does not extend into the additional bend region.

7. The clamping spring according to claim 2, wherein the corrugation has a bent contour that follows the bent course of the clamping leg in the bend region.

8. The clamping spring according to claim 2, wherein the corrugation spans the bend region in a straight line.

9. The clamping spring according to claim 1, wherein an angle between the first and the second regions of the clamping leg formed by the bend region is at least 10 degrees or at least 15 degrees.

10. The clamping spring according to claim 1, wherein, in the region of the corrugation, the material of the clamping leg is deformed into an indentation on a stamped side of the clamping leg and into a projection on the side opposite the stamped side.

11. The clamping spring according to claim 10, wherein the convex-shaped side of the bend region forms the stamped side.

12. The clamping spring according to claim 10, wherein the height of the projection is less than the material thickness of the clamping leg in the bend region.

13. The clamping spring according to claim 1, wherein the corrugation does not extend over the entire width of the clamping leg.

14. The clamping spring according to claim 1, wherein the clamping leg has at least one narrowing by which the width of the clamping leg is reduced from the spring bend in the direction of the free end of the clamping leg, wherein the corrugation is arranged in the region of the clamping leg that has the narrowing.

15. The clamping spring according to claim 1, wherein the corrugation has its greatest length dimension in the direction of the longitudinal extent of the clamping leg.

16. A conductor connection terminal for connection of an electrical conductor via a spring-loaded clamping, the conductor connection terminal comprising:

at least one clamping spring according to claim 1;

a busbar; and an insulating housing that at least substantially encloses the clamping spring and the busbar.

17. The conductor connection terminal according to claim 16, wherein the conductor connection terminal has a pivoting operating lever for manual operation of the clamping leg of the clamping spring to open and/or close a clamping point formed between the clamping leg and the busbar for clamping the electrical conductor.

18. The clamping spring according to claim 1, further comprising a bent clamping edge disposed at an end of the clamping leg.

19. The clamping spring according to claim 1, further comprising a bent attachment section disposed at an end of the support leg.

20. A clamping spring of a conductor connection terminal for connecting an electrical conductor via a spring-loaded clamping, the clamping spring comprising:

a support leg configured to fix the clamping spring in the conductor connection terminal;

a spring bend adjoining the support leg;

a clamping leg adjoining the spring bend, the clamping leg having a bent portion; and a corrugation stamped into a material of the clamping leg in the bent portion, the corrugation having a bent contour corresponding to the bent portion of the clamping leg, wherein the clamping leg is arranged to clamp the electrical conductor via its free end.

21. A clamping spring of a conductor connection terminal for connecting an electrical conductor via a spring-loaded clamping, the clamping spring comprising:

a support leg to fix the clamping spring in the conductor connection terminal;

a spring bend adjoining the support leg; and a clamping leg adjoining the spring bend, wherein the clamping leg is arranged to clamp the electrical conductor via its free end, and wherein the clamping leg has at least one corrugation stamped into a material of the clamping leg from a side of the clamping leg facing the support leg.

* * * * *